United States Patent [19]

Sakaki et al.

[11] Patent Number: 4,746,591

[45] Date of Patent: May 24, 1988

[54] PROCESS FOR PRODUCING PRESENSITIZED LITHOGRAPHIC PRINTING PLATE WITH LIQUID HONED ALUMINUM SUPPORT SURFACE

[75] Inventors: Hirokazu Sakaki; Akira Shirai; Akio Uesugi; Tsutomu Kakei, all of Shizuoka, Japan

[73] Assignee: Fuji Photo Film Co., Ltd., Kanagawa, Japan

[21] Appl. No.: 903,907

[22] Filed: Sep. 4, 1986

Related U.S. Application Data

[63] Continuation of Ser. No. 631,416, Jul. 16, 1984, abandoned.

[30] Foreign Application Priority Data

Jul. 14, 1983 [JP] Japan ..... 58-128228

[51] Int. Cl.[4] ..... G03C 1/94; G03C 1/96; G03C 1/54

[52] U.S. Cl. ..... 430/168; 430/155; 430/158; 430/166; 430/169; 430/175; 430/189; 430/276; 430/278; 430/302; 204/33; 101/459

[58] Field of Search ..... 430/302, 278, 276, 158, 430/155, 166, 168, 175, 189, 169; 204/33; 101/459

[56] References Cited

U.S. PATENT DOCUMENTS

| | | | |
|---|---|---|---|
| 3,891,516 | 6/1975 | Chu | 430/302 |
| 3,929,591 | 12/1975 | Chu et al. | 101/459 |
| 4,072,589 | 2/1978 | Golda et al. | 101/459 |
| 4,087,341 | 5/1978 | Takahashi et al. | 204/129.43 |
| 4,183,788 | 1/1980 | Fromson et al. | 101/459 |
| 4,301,229 | 11/1981 | Sakaki et al. | 430/160 |
| 4,324,841 | 4/1982 | Huang | 430/302 |
| 4,427,500 | 1/1984 | Platzer | 430/165 |
| 4,476,006 | 10/1984 | Ohba et al. | 430/276 |
| 4,477,317 | 10/1984 | Chu et al. | 204/33 |
| 4,492,616 | 1/1985 | Pliefke et al. | 430/302 |
| 4,613,413 | 9/1986 | Uesugi et al. | 204/33 |

FOREIGN PATENT DOCUMENTS

| | | |
|---|---|---|
| 1557281 | 12/1979 | United Kingdom . |
| 2047274 | 11/1980 | United Kingdom . |
| 2060923 | 5/1981 | United Kingdom . |

OTHER PUBLICATIONS

Chemical Abstracts, #154348e, vol. 75, 1971.

English Language Abstracts of Jap Kokai 50-136,101 & Jap Koho 79-42282, Patented 12/1979.

Japanese Patents Report, Section Ch, vol. 79, No. 51, Jan. 25, 1980, Derwent Publications Ltd., London.

*Primary Examiner*—Charles L. Bowers, Jr.

*Attorney, Agent, or Firm*—Sughrue, Mion, Zinn, MacPeak & Seas

[57] ABSTRACT

A process for preparing a lithographic support, and the printing plate made therefrom, are described, wherein the process comprises the steps of (a) liquid-honing a surface of an aluminum sheet, and (b) electrochemically graining the surface of the aluminum sheet in an electrolyte comprises hydrochloric acid, nitric acid, or a mixture thereof.

21 Claims, No Drawings

PROCESS FOR PRODUCING PRESENSITIZED LITHOGRAPHIC PRINTING PLATE WITH LIQUID HONED ALUMINUM SUPPORT SURFACE

This is a continuation of application Ser. No. 631,416, filed July 16, 1984, abandoned.

FIELD OF THE INVENTION

This invention relates to a process for producing a support for a lithographic printing plate and, more particularly, to a process for roughening a surface of an aluminum sheet used as a support.

BACKGROUND OF THE INVENTION

In the field of lithographic printing plates, so-called presensitized printing plates comprising an aluminum support having thereon a light-sensitive layer composed of a light-sensitive composition have hitherto been employed. The aluminum support used in the presensitized lithographic printing plates generally has a surface roughened by a process selected from various roughening processes, such as mechanical roughening processes including ball graining, wire graining, brush graining, and liquid honing; an electrochemical roughening process called electrolytic graining; chemical roughening processes; and certain combinations of two or more of these processes.

Typically employed roughening processes include a mechanical roughening process, an electrochemical roughening process, and certain combinations thereof, but each of these techniques has respective disadvantages as set forth below.

Wire graining is unsuitable for obtaining commercially usable prints of high quality due to the simple structure of the wire. The brush graining involves orientation of the rotating brush, which results in a non-uniform surface of the aluminum plate. Electrolytic graining requires a large energy for attaining a desired roughness and precise control of electrolysis conditions for stably obtaining a constant surface quality.

In order to attempt to overcome some of the above-described disadvantages associated with each graining process, an improved process comprising a combination of the brush graining or wire graining and the electrolytic graining has been proposed, as disclosed in U.S. Pat. No. 2,344,510 and Japanese patent application (OPI) No. 123204/78 (the term "OPI" as used herein refers to a "published unexamined Japanese patent application"), and British Pat. Nos. 1,582,620 and 2,047,274. According to such combined process, however, when the brush graining is adopted as a first step, i.e., a mechanical graining step, stains are apt to be formed in the non-image areas during printing, and when the wire graining is adopted as the first step, the printing plate has poor printing durability.

SUMMARY OF THE INVENTION

Accordingly, an object of this invention is to provide a process for roughening a surface of an aluminum sheet so as to have a uniform roughness suitable for presensitized lithographic printing plates.

Another object of this invention is to provide a process for producing a support for presensitized printing plates excellent in printing durability and freedom from stains.

Still another object of this invention is to provide a process for stably producing a support having a uniform roughness for presensitized lithographic printing plates, which process is suitable for mass production.

The present inventors have noted differences in performance of lithographic printing plates depending on the mechanical roughening process employed in the above-described combined roughening process. As a result of intensive studies, it has now been found that a support having excellent performance characteristics can be obtained by using a particular combination of a specific liquid honing step for a first mechanical graining and then conducting a specific electrochemical graining roughening.

The present invention relates to a process for preparing a lithographic support, which comprises the steps of (a) liquid-honing a surface of an aluminum sheet, and (b) electrochemically graining the surface of the aluminum sheet in an electrolyte comprising hydrochloric acid, nitric acid, or a mixture thereof.

DETAILED DESCRIPTION OF THE INVENTION

Aluminum sheets which can be used in the present invention as a raw material for the support include a pure aluminum sheet and an aluminum alloy sheet. The aluminum alloy may be composed of aluminum as a main component and small amounts of silicon, iron, copper, zinc, manganese, magnesium, chromium, bismuth, calcium, indium, gallium, nickel, etc. In any case, the aluminum preferably has a purity of 95% by weight or more.

The thickness of the aluminum sheet is properly selected from the range of from 0.1 to 0.5 mm according to strength, resistance, elongation, etc., required for the particular application of the lithographic printing plate to a printing machine.

Roughening of a surface of the aluminum sheet is advantageously carried out by liquid honing by the use of concentrical jetter with rotatory stirring wings, as disclosed in Japanese Patent Application (OPI) No. 136101/75.

A particularly preferred method of liquid honing comprises jetting a high-pressure liquid at a high flow rate from a nozzle, joining the stream of the high-pressure liquid with a slurry containing a fine powder of an abrasive jetted from a spout, and directing the joined stream to strike against a surface of the aluminum sheet.

An apparatus for carrying out the above-described method of liquid honing comprises at least one nozzle connected to a feeder of the high-pressure liquid and a spout connected to a feeder of the abrasive slurry, wherein the nozzle and the spout are arranged so that the slurry spouted from the latter is joined with the stream of the high-pressure liquid jetted from the former. In case of using plural nozzles for jetting the high-pressure liquid, they may be provided around the spout for the abrasive slurry.

The feeder for the high-pressure liquid has various embodiments including, for example, a container containing a liquid kept at a high liquid pressure or a system composed of a container containing a liquid at an atmospheric pressure and a pressure spouting pump connected to the container. In any embodiment, it is preferred that the liquid be jetted from the nozzle(s) at a flow rate of 30 to 140 m/second, and more preferably 70 to 120 m/second. The liquid pressure for attaining such a flow rate is from 5 to 100 kg/cm$^2$, and preferably from 30 to 50 kg/cm$^2$.

On the other hand, the feeder for the abrasive slurry comprises a container for the slurry, and, desirably, a means for stirring the slurry to prevent precipitation of solids. The means for stirring to prevent precipitation of solids may be a propeller stirrer inserted in the container or may be a system of circulating the slurry. By constantly moving the slurry, the solids in the slurry can be prevented from precipitating. The container is connected to the spout via a tube, e.g., a pressure-resisting hose, and a pump for spouting the slurry is provided in the middle of the connecting tube. The feeder for the abrasive slurry having the above-described construction feeds the slurry in a stirred state to the spout through the connecting tube by means of the pump thereby to spout the abrasive slurry from the spout. It is preferred that the spouting rate of the slurry be from 2 to 25 m/second.

The slurry comprises water and a fine powder of an abrasive. The fine powder abrasive is used at a concentration of from about 5 to about 80% by weight, and preferably from 30 to 50% by weight, in the slurry. Useful abrasives include diamond, quartz, flint, granite, alundum, silica, diatomaceous earth, sand, emery, garnet, talc, pumice, corundum, dolomite, magnesium oxide, etc. These abrasives are used in a desired particle size, e.g., #20 to #4,000, preferably #90 to #360, more preferably #150 to #360, which are the mean value according to JIS Z8801-1956.

In order to carry out chemical cleaning simultaneously with the mechanical graining, the high-pressure liquid or slurry used for the liquid honing may contain acids or alkalis, if desired.

In the present invention, the stream of the slurry is accelerated by the stream of the high-pressure liquid to strike against the surface of the aluminum sheet. The angle of the striking stream against the aluminum sheet preferably ranges from about 15° to about 165°, preferably 30° to 90°.

The above-described liquid honing is suitably carried out so that the surface of the aluminum sheet has a center-line average roughness (Ra) of from about 0.3 to about 1.2 μm, and preferably from 0.35 to 0.8 μm, at a cut-off value of 0.08.

The aluminum sheet having the thus grained surface is then subjected to alkali etching, if desired. When it is necessary to uniformly conduct the subsequent electrochemical graining hereinafter described, this etching treatment is preferred. The etching treatment may also be carried out using a solution which etches aluminum, for example, an acid, e.g., fluoric acid, phosphoric acid, sulfuric acid, etc. Preferred alkalis which can be used for the etching treatment include sodium hydroxide, potassium hydroxide, sodium metasilicate, sodium carbonate, sodium aluminate, sodium gluconate, etc. The etching is preferably carried out at a temperature of from normal temperature to 90° C. for a period of from 5 seconds to 5 minutes with an etching solution having a concentration of 1 to 50% by weight until 0.1 to 10 g/m$^2$ of aluminum is etched.

Since the thus alkali-etched aluminum surface contains unetched, alkali-insoluble substances (smut), the aluminum plate should be desmutted in an acidic solution, e.g., an aqueous solution of nitric acid, sulfuric acid or phosphoric acid.

Subsequently, the surface of the aluminum plate is roughened by electrochemical graining. The electrochemical graining is carried out by electrolysis in an electrolyte comprising a 0.1 to 10wt%, and preferably 0.3 to 3 wt%, hydrochloric acid or nitric acid solution or a mixture thereof using a direct or alternating current power source, thereby to form a second roughness on the aluminum sheet. The second roughness has a pit depth of from 0.1 to 1μ, and preferably from 0.1 to 0.8μ, and a pit diameter of from 0.1 to 5μ, and preferably 0.1 to 3μ.

Formation of such pit diameter is advantageously effected by using special alternating current having specific waves as described in U.S. Pat. No. 4,087,341, in which the second roughness can be economically and uniformly formed by controlling the electrolytic waves. Further, the electrolyte may contain amines, gluconic acid, boric acid, phosphoric acid, fluoric acid, etc., as described in U.S. Pat. Nos. 3,963,564, 3,980,539, etc.

It is preferably that the aluminum sheet having the second roughness thus formed is subsequently treated with an acid or alkali solution. Specific examples of useful acids include sulfuric acid as described in Japanese Patent Publication No. 11316/81 and a mixture of phosphoric acid and chromic acid. On the other hand, the alkali treatment comprises lightly etching the surface with an alkaline solution, such as a sodium hydroxide aqueous solution as described in Japanese Patent Publication No. 28123/73 and British Pat. No. 2,060,923, to remove smut that may be stuck to the surface. In case of the alkali treatment, since the alkali-insoluble matter remains on the etched surface, the aluminum sheet should be subjected to desmutting with an acid solution, e.g., sulfuric acid, phosphoric acid, chromic acid, etc.

The thus treated aluminum sheet is then anodically oxidized in sulfuric acid, phosphoric acid or a mixture thereof. An anodic oxidation film is preferably formed in a thickness of from 0.1 to 10 g/m$^2$, and more preferably from 0.3 to 5 g/m$^2$. The conditions for anodic oxidation are not particularly limited, varying depending on the type of the electrolytic solution used, but it is generally preferred to use the conditions of a concentration of the electrolytic solution of from 1 to 80% by weight, a liquid temperature of from 5° to 70° C., a current density of from 0.5 to 60 A/dm$^2$, an electric voltage of from 1 to 100 v, and an electrolysis time of from 10 to 100 seconds.

Preferred embodiments of the anodic oxidation include a method of using sulfuric acid and a high current density as disclosed in British Pat. No. 1,412,768 and a method of using phosphoric acid as an electrolytic bath as disclosed in U.S. Pat. No. 3,511,661.

If desired, the anodically oxidized aluminum sheet is then subjected to soaking in an aqueous solution of an alkali metal silicate, e.g., sodium silicate, as described in U.S. Pat. Nos. 2,714,066 and 3,181,461, or a subbing layer comprising a hydrophilic cellulose, e.g., carboxymethyl cellulose, containing a water-soluble metal salt, e.g., zinc acetate, as described in U.S. Pat. No. 3,860,426 may be formed thereon.

Onto the aluminum support according to the present invention, a conventionally known light-sensitive layer is formed to obtain a presensitized lithographic printing plate precursor, which is then exposed to light and developed to produce a lithographic printing plate having excellent performance.

Compositions used for the above-described light-sensitive layer include the following examples:

(1) A light-sensitive composition comprising a diazo resin and a binder

Preferred examples of the diazo resin are those described in U.S. Pat. Nos. 2,063,631 and 2,667,415, Japanese Patent Publication Nos. 48001/74, 45322/74 and 45323/74 and British Pat. No. 1,312,925. Preferred examples of the binder are those described in British Pat. Nos. 1,350,521 and 1,460,978 and U.S. Pat. Nos. 4,123,276, 3,751,257 and 3,660,097.

(2) A light-sensitive composition comprising an o-quinonediazide compound

Preferred o-quinonediazide compounds are o-naphthoquinonediazide compounds as described, for example, in U.S. Pat. Nos. 2,766,118, 2,767,092, 2,772,972, 2,859,112, 2,907,665, 3,046,110, 3,046,111, 3,046,115, 3,046,118, 3,046,119, 3,046,120, 3,046,121, 3,046,122, 3,046,123, 3,061,430, 3,102,809, 3,106,465, 3,635,709, and 3,647,443, as well as many other disclosures in the literature.

(3) A light-sensitive composition comprising an azide compound and a high molecular binder, including a composition comprising an azide compound and a water-soluble or alkali-soluble high molecular compound as described in British Pat. Nos. 1,235,281 and 1,495,861 and Japanese Patent Application (OPI) Nos. 32331/76 and 36128/76, and a composition comprising a polymer containing an azido group and a high molecular binder as described in Japanese Patent Application (OPI) Nos. 5102/75, 84302/75, 84303/75 and 12984/78.

(4) Other light-sensitive resin compositions, including polyester compounds described in Japanese Patent Application (OPI) No. 96696/77, polyvinyl cinnamate type resins as described in British Pat. Nos. 1,112,277, 1,313,390, 1,341,004 and 1,377,747, and photopolymerizable photopolymer compositions as described in U.S. Pat. Nos. 4,072,528 and 4,072,527.

These light-sensitive compositions can appropriately contain various additives, such as sensitizers to increase sensitivity, e.g., cyclic acid anhydrides; dyes as developing-out agents for visualizing the exposed images immediately after the exposure to light, thickeners for image areas, coloring agents for coloring a printing plate surface, and the like.

The above-described components are properly blended and dissolved in an organic solvent to prepare a coating composition. A concentration of the coating composition is from 2 to 50% by weight on a solid base. The coating composition is then applied to the above-described aluminum support according to a coating method selected from a roll coating method, a reverse roll coating method, a gravure coating method, an air knife coating method, etc. The amount of the composition to be coated is typically from about 0.1 to 7.0 g/m$^2$, and preferably 0.5 to 4.0 g/m$^2$, on the sheet. After coating, the composition is dried, and, if desired, cut into appropriate size pieces.

The printing plate precursor thus produced is imagewise exposed to light and developed with a developer, for example, by immersing the plate in a developer bath or spraying the plate with a developer. The developer to be used is specific to each coating composition and can be selected from the specific examples given in the above-enumerated references correspondingly to each composition. For example, for a light-sensitive layer comprising a diazo compound and an organic high molecular binder, aqueous alkaline developers described in U.S. Pat. Nos. 3,475,171, 3,669,660, 4,186,006, etc., are used.

The light-sensitive compositions include positive type compositions in which exposed areas are removed by development processing, and negative type compositions in which non-exposed areas are removed by development processing, and the type of composition to be used is determined according to the particular purpose of the printing or working details.

After the development processing, the resulting printing plate may be subjected to additional following-up treatments, if desired. Such treatments include application of desensitizing gum as disclosed in U.S. Pat. Nos. 4,253,999, 4,268,613 and 4,348,954 and burning-in treatment as disclosed in U.S. Pat. Nos. 4,191,570, 4,294,910 and 4,355,096.

The present invention will now be illustrated in greater detail with reference to examples, but it should be understood that the present invention is not limited thereto. In these examples, all percentages are by weight unless otherwise indicated.

EXAMPLE 1

A suspension consisting of pumice having an average particle size of 100$\mu$ and water was spouted to join with a water stream jetted from a nozzle at a pressure of 50 kg/cm$^2$, and the mixed stream was directed to strike against a surface of a JIS 1050 aluminum sheet at an angle of 30° to form a rough surface. The striking was carried out uniformly over the entire surface of the aluminum sheet. The average center-line roughness of the resulting aluminum sheet was 0.5$\mu$.

The rough surface of the aluminum sheet was etched with a 10% aqueous solution of sodium hydroxide (60° C.) to an etched aluminum amount of 2 g/m$^2$. After washing with water, the aluminum sheet was desmutted in a 20% aqueous solution of nitric acid and then subjected to electrolysis in a 1% nitric acid aqueous solution at a current density of 25 A/dm$^2$ using alternating current. Subsequently, the sheet was dipped in a 15% aqueous solution of sulfuric acid at 50° C. for 3 minutes for desmutting, and anodically oxidized in an electrolytic solution comprising a 20% sulfuric acid aqueous solution at a bath temperature of 30° C. to form an anodic oxidation film of 3 g/m$^2$. The resulting support was designated as Support I.

The same procedures as described above were repeated except that the first mechanical roughening by the mixed stream of the pumice-water suspension and the high-pressure liquid was replaced by brush graining using a rotating nylon brush while applying a pumice-water suspension to obtain Support II having an average center-line roughness of 0.5$\mu$, or wire brush graining to obtain Support III having the same roughness as that of Support II.

Onto the surface of each of Supports I, II, and III was coated a light-sensitive composition having the following composition, in an amount of 2.5 g/m$^2$ on a dry basis, followed by drying to obtain Presensitized Lithographic Printing Plate Precursors I, II, and III, respectively.

| Light-Sensitive Composition | |
|---|---|
| An ester compound of naphthoquinone-1,2-diazido-5-sulfonyl chloride, pyrogallol and an acetone resin (as described in Example 1 of U.S. Pat. No. 3,635,709) | 0.75 g |
| Cresol novolak resin | 2.00 g |
| Oil Blue #603 (an oil-soluble blue | 0.04 g |

-continued

| Light-Sensitive Composition | |
|---|---|
| dye manufactured by Orient Kagaku K. K.) | |
| Ethylene dichloride | 16 g |
| 2-Methoxyethyl acetate | 12 g |

Each of the thus prepared presensitized printing plate precursors was brought into intimate contact with a transparent positive pattern and exposed to light emitted from a 3 kw metal halide lamp from a distancce of 1 m for 50 seconds through the pattern. The exposed plate was then developed with a 5.26% aqueous solution of sodium silicate ($SiO_2/Na_2O$ molar ratio: 1.74).

When the resulting Lithographic Printing Plates I, II and III were mounted on a printer "KOR" manufactured by Heidelberg Co. (West Germany) to carry out printing, the results as shown in Table 1 were obtained. From Table 1, it can be seen that the support according to the present invention (Support I) has excellent performances of preventing stains in non-image areas and printing durability.

TABLE 1

| Support No. | Stains in Non-Image Areas | Printing Durability |
|---|---|---|
| I | Excellent | More than 100,000 prints |
| II | Good | 100,000 prints |
| III | Good | 80,000 prints |

EXAMPLE 2

A slurry of pumice having an average particle size of 150μ suspended in water was spouted to join with a water stream jetted from a nozzle at a pressure of 20 kg/cm$^2$, and the mixed stream was directed to strike against a surface of a JIS 1050 aluminum sheet at an angle of 45°. Similarly, a slurry of pumice having an average particle size of 40μ was spouted to join with a water stream jetted from a nozzle at a pressure of 20 kg/cm$^2$, and the mixed stream was allowed to strike against the same aluminum surface at an angle of 90° (perpendicular) to form a uniform rough surface having an average center-line roughness of 0.7μ.

After washing with water, the aluminum sheet was etched with a 30% aqueous solution of sodium hydroxide at 60° C. to etch 6 g/m$^2$ of aluminum, followed by washing with water. The etched aluminum sheet was desmutted by soaking in a 20% aqueous solution of nitric acid to remove any insoluble residue on the surface. After washing with water, the surface of the sheet was subjected to electrochemical graining in a 0.7% nitric acid aqueous solution using an alternating wave current as described in U.S. Pat. No. 4,087,341 (corresponding to Japanese Patent Publication No. 19191/80) under electrolysis conditions of $V_A=12.7$ V, $V_C=9.1$ V, and an anodic electric amount of 160 coulomb/dm$^2$. Thereafter, an anodic oxidation film having a thickness of 2 g/m$^2$ was formed in a 20% sulfuric acid aqueous solution, followed by washing with water. The sheet was then soaked in a 2.5% sodium silicate aqueous solution at 70° C. for 30 minutes, washed with water, and dried. The light-sensitive composition of the following composition was applied onto the thus treated aluminum sheet to a thickness of 2.0 g/m$^2$ on a dry basis, followed by drying to obtain a presensitized lithographic printing plate precursor.

| Light-Sensitive Composition | |
|---|---|
| An N—(4-hydroxyphenyl)methacrylamide/2-hydroxyethyl methacrylate/acrylonitrile/methyl methacrylate/methacrylic acid copolymer (15:10:30:38:7 by mol; average molecular weight: 60,000) | 5.0 g |
| A hexafluorophosphate of a condensate between 4-diazodiphenylamine and formaldehyde | 0.5 g |
| Phosphorous acid | 0.05 g |
| Victoria Pure Blue BOH (a dye manufactured by Hodogaya Chemical Co., Ltd.) | 0.1 g |
| 2-Methoxyethanol | 100 g |

The resulting printing plate precursor was exposed to light emitted from a 3 kw metal halide lamp from a distance of 1 m for 30 seconds through a negative transparent pattern, and developed by immersing in a developer having the following composition.

| Developer | |
|---|---|
| Sodium sulfite | 5 g |
| Benzyl alcohol | 30 g |
| Sodium carbonate | 5 g |
| Sodium isopropylnaphthalenesulfonate | 12 g |
| Pure water | 1,000 ml |

The thus prepared lithographic printing plate was used for printing in a usual manner to obtain clear prints free from stains in the non-image areas.

EXAMPLE 3

The same procedures as described in Example 2 were repeated except that the nitric acid used as an electrolyte for the electrochemical graining was replaced by hydrochloric acid having the same concentration. There were obtained excellent prints free from stains in the non-image areas.

While the invention has been described in detail and with reference to specific embodiments thereof, it will be apparent to one skilled in the art that various changes and modifications can be made therein without departing from the spirit and scope thereof.

What is claimed is:

1. A process for preparing a presensitized lithographic printing plate precursor which comprises the steps of:

(a) liquid-honing a surface of an aluminum sheet by jetting a high-pressure liquid from at least one nozzle at a high flow rate, joining a slurry containing a fine powder of an abrasive with the jetted high-pressure liquid stream, and directing the resulting mixed stream to strike against a surface of the aluminum sheet; then (b) electrochemically graining the surface of the aluminum sheet in an electrolyte comprising hydrochloric acid, nitric acid, or a mixture thereof and thereafter (c) coating a layer of a light-sensitive composition comprising (1) a diazo resin and a binder or (2) an o-quinonediazide compound on said surface.

2. A process of claim 1, wherein the process further includes the step of chemically etching the surface of the aluminum sheet after the step (a) but prior to the step (b).

3. A process of claim 2, wherein the process further includes the step of anodizing the aluminum sheet after the step (b) but prior to the step (c).

4. A process of claim 3, wherein the high-pressure liquid is jetted from at least one nozzle at a flow rate of from 30 to 140 m/second at a pressure of from 5 to 100 $kg/cm^2$, and the slurry is spouted from a spout at a flow rate of from 2 to 25 m/second.

5. A process of claim 3, wherein the slurry contains a fine powder of an abrasive in an amount of from 5 to 80% by weight.

6. A process of claim 3, wherein the slurry contains a fine powder of an abrasive in an amount of from 30 to 50% by weight.

7. A process of claim 3, wherein the liquid honing is carried out to form an average center-line roughness of from 0.35 to 0.8 $\mu$m.

8. A process of claim 3, wherein the chemical etching is carried out by using an etching solution comprising an acid or an alkali to etch from 0.1 to 10 $g/m^2$ of aluminum.

9. A process of claim 3, wherein the process further includes desmutting the etching aluminum sheet after the chemical etching.

10. A process of claim 3, wherein the electrochemical graining is carried out to form a roughness having a pit depth of from 0.1 to 1$\mu$ and a pit diameter of from 0.1 to 5$\mu$.

11. A process of claim 3, wherein the electrochemical graining is carried out to form a roughness having a pit depth of from 0.1 to 0.8$\mu$ and a pit diameter of from 0.1 to 3$\mu$.

12. A process of claim 3, wherein the anodic oxidation is carried out in a 1 to 80 wt% aqueous solution of sulfuric acid, phosphoric acid or a mixture thereof, at a temperature of from 5° to 70° C., at a current density of from 0.5 to 60 $amperes/dm^2$, at a voltage of from 1 to 100 v, and for a time period of from 10 to 100 seconds.

13. A process of claim 12, wherein the anodic oxidation is carried out to form an anodic oxidation film having a thickness of from 0.1 to 10 $g/m^2$.

14. A process of claim 12, wherein the anodic oxidation is carried out to form an anodic oxidation film having a thickness of from 0.3 to 5 $g/m^2$.

15. A process of claim 1, wherein the slurry contains an acid or an alkali.

16. A process of claim 1, wherein the liquid honing is carried out to form an average center-line roughness of from about 0.3 to 1.2 $\mu$m.

17. A process of claim 1, wherein said electrolyte comprises 0.1 to 10 wt% hydrochloric acid, nitric acid, or a mixture thereof.

18. A process of claim 1, wherein said mixed stream is allowed to strike against the aluminum surface at an angle of from about 15° to about 165°.

19. A presensitized lithographic printing plate precursor produced by the process of claim 1.

20. A presensitized lithographic printing plate precursor produced by the process of claim 2.

21. A presensitized lithographic printing plate precursor produced by the process of claim 3.

* * * * *